US006691535B2

(12) United States Patent
Gotta et al.

(10) Patent No.: US 6,691,535 B2
(45) Date of Patent: Feb. 17, 2004

(54) FABRIC FOR THE FORMATION OF GARMENT PIECES, THE GARMENT PIECES OBTAINED THEREFROM AND THE GARMENTS PRODUCED THEREWITH

(75) Inventors: Gerhard Gotta, Rodgau (DE); Jörg Bredemeyer, Obertshausen (DE)

(73) Assignee: Karl Mayer Textilmaschinenfabrik GmbH, Obertshausen (DE)

( * ) Notice: Subject to any disclaimer, the term of this patent is extended or adjusted under 35 U.S.C. 154(b) by 93 days.

(21) Appl. No.: 09/967,521

(22) Filed: Sep. 28, 2001

(65) Prior Publication Data

US 2002/0079015 A1 Jun. 27, 2002

(30) Foreign Application Priority Data

Sep. 30, 2000 (DE) ..... 200 16 943 U

(51) Int. Cl.[7] ..... D04B 21/00
(52) U.S. Cl. ..... 66/195; 66/172 E
(58) Field of Search ..... 66/195, 193, 175, 66/177, 192, 172 E, 176, 171; 442/306

(56) References Cited

U.S. PATENT DOCUMENTS

| | | | | | |
|---|---|---|---|---|---|
| 3,654,779 | A | * | 4/1972 | Fors | 66/171 |
| 3,656,324 | A | * | 4/1972 | Jackson | 66/177 |
| 3,673,820 | A | * | 7/1972 | Sarmiento | 66/177 |
| 3,685,319 | A | * | 8/1972 | Jackson | 66/87 |
| 3,703,820 | A | * | 11/1972 | Jackson | 66/177 |
| 4,527,404 | A | * | 7/1985 | Nakagaki et al. | 66/202 |
| 4,748,078 | A | * | 5/1988 | Doi et al. | 442/312 |
| 5,172,570 | A | * | 12/1992 | Wade et al. | 66/195 |
| 5,517,832 | A | * | 5/1996 | Kristensen | 66/177 |
| 6,276,177 | B1 | * | 8/2001 | West | 66/192 |
| 6,401,497 | B1 | * | 6/2002 | Nishiyama et al. | 66/172 E |

* cited by examiner

*Primary Examiner*—Danny Worrell
(74) *Attorney, Agent, or Firm*—McCarter & English, LLP

(57) ABSTRACT

The present invention relates to a fabric structure for the production of garment pieces that are combined with other garment pieces to create garments. The fabric structure includes a plurality of pattern areas corresponding to the garment pieces and connected to one another by filling areas, wherein each pattern area includes at least two different patterns and at least one elastic function zone.

10 Claims, 2 Drawing Sheets

FABRIC FOR THE FORMATION OF GARMENT PIECES, THE GARMENT PIECES OBTAINED THEREFROM AND THE GARMENTS PRODUCED THEREWITH

BACKGROUND OF THE INVENTION

1. Field of the Invention

The present invention relates to a fabric structure for the production of garment pieces that includes a plurality of pattern areas corresponding to the garment pieces.

2. Description of the Prior Art

German Gebrauchmusters No. 299 15 625 (hereinafter referred to as "DE 299 15 625"), which is hereby incorporated herein by reference, discloses a fabric structure that includes a plurality of pattern areas corresponding to the garment pieces and connected to one another by filling areas. The garment pieces disclosed in DE 299 15 6250 are obtained by separating the pattern areas from one another and removing the filling areas from therebetween. The garment pieces can then be further manipulated and directly incorporated into the garment itself. The patterns can be distinguished by the weaving of the threads of the ground fabric and/or in the weaving of pattern threads carried by the ground fabric. They can also be differentiated by thread density and/or thread material.

In German Patent No. 865 346, it is disclosed that form knitted articles, such as medical body bandages, bandages, belts for particular circumstances, slip bodices, corselets, swimsuits and the like, may be made in an elastic fashion. For this purpose, elastic threads are bound into the fabric in the warp and/or weft direction.

SUMMARY OF THE INVENTION

The object of the present invention is to provide a fabric structure relating to the above described art which has improved properties. This object is achieved by weaving elastic function zones into the garment pieces. More particularly, the elastic function zones are formed by weaving a plurality of elastic threads into successive pattern areas, in the warp direction of the fabric structure, along a contour which deviates from a path parallel to the warp direction.

In this way, elastic function zones are formed in the pattern areas, which in view of the contour path can be particularly well suited to their tasks. Thus, an elastic function zone can operate in the completed garment in a manner especially suitable to the body of the male or female wearer. There are thus obtained compression surfaces which enable a sealing holding of diapers and other articles. The elastic function zone also alters the size, density, stability, and or return-spring capability of the pattern covered by the elastic function zone.

In a preferred embodiment, at least two thread groups, each including a plurality of elastic threads, are woven into a pattern area in a differentiable manner. This raises a number of variation possibilities.

In one variation of the preferred embodiment, the thread groups are woven along different contours. In a second variation, the thread groups are woven with different densities. In a third variation, the thread groups are woven with differentiable thread tension.

Furthermore, the thread groups may be woven such that they overlap each other.

In another preferred embodiment, the elastic threads are woven such that they cross at least two different patterns within a pattern area.

In all cases which employ at least two different thread groups, there are provided elastic function zones which are formed in a differentiable manner and hence may be particularly well suited to the desired final purpose. Each of the foregoing variations concerning the weaving of the elastic threads can be implemented during the knitting process. In addition, each of the foregoing variations results in the production of garment pieces that are ready and suitable for direct incorporation into a garment.

Furthermore, the present invention includes a garment piece obtained from the above-described fabric structure, as well as a garment that includes such a garment piece.

BRIEF DESCRIPTION OF THE DRAWINGS

The present invention can be further understood by reference to the preferred embodiment illustrated in the accompanying drawings, in which.

DETAILED DESCRIPTION OF THE INVENTION

Figure 1:
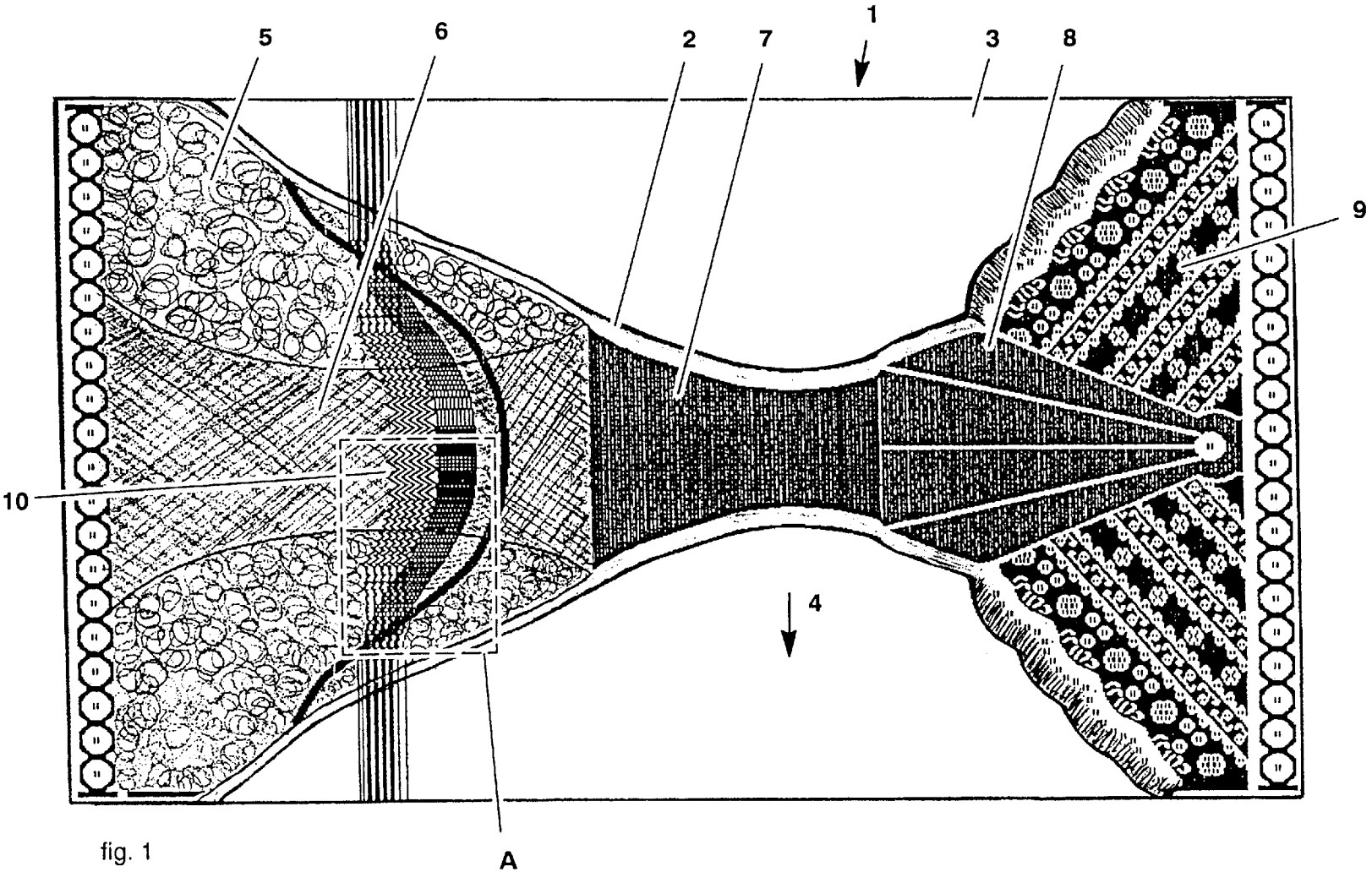
FIG. 1 is a segment of a fabric structure created in accordance with the present invention.

With reference to FIG. 1, a portion of the fabric structure of the present invention is shown and includes a pattern area 2 and a filling area 3. Identical portions (not shown) are attached thereto on the left and right as well as above and below the illustrated portion, thus creating a fabric structure having successive, repeated pattern areas. The fabric structure shown in FIG. 1 has a path that runs in the warp direction shown by arrow 4.

As illustrated in FIG. 1, the pattern area 2 includes a plurality of patterns 5, 6, 7, 8 and 9, which have been created in a warp knitting machine as is set forth in detail in the aforementioned DE 29915625, discussed above (which corresponds to U.S. Ser. No. 09/649,629, filed Aug. 28, 2000 and now abandoned).

Figure 2:
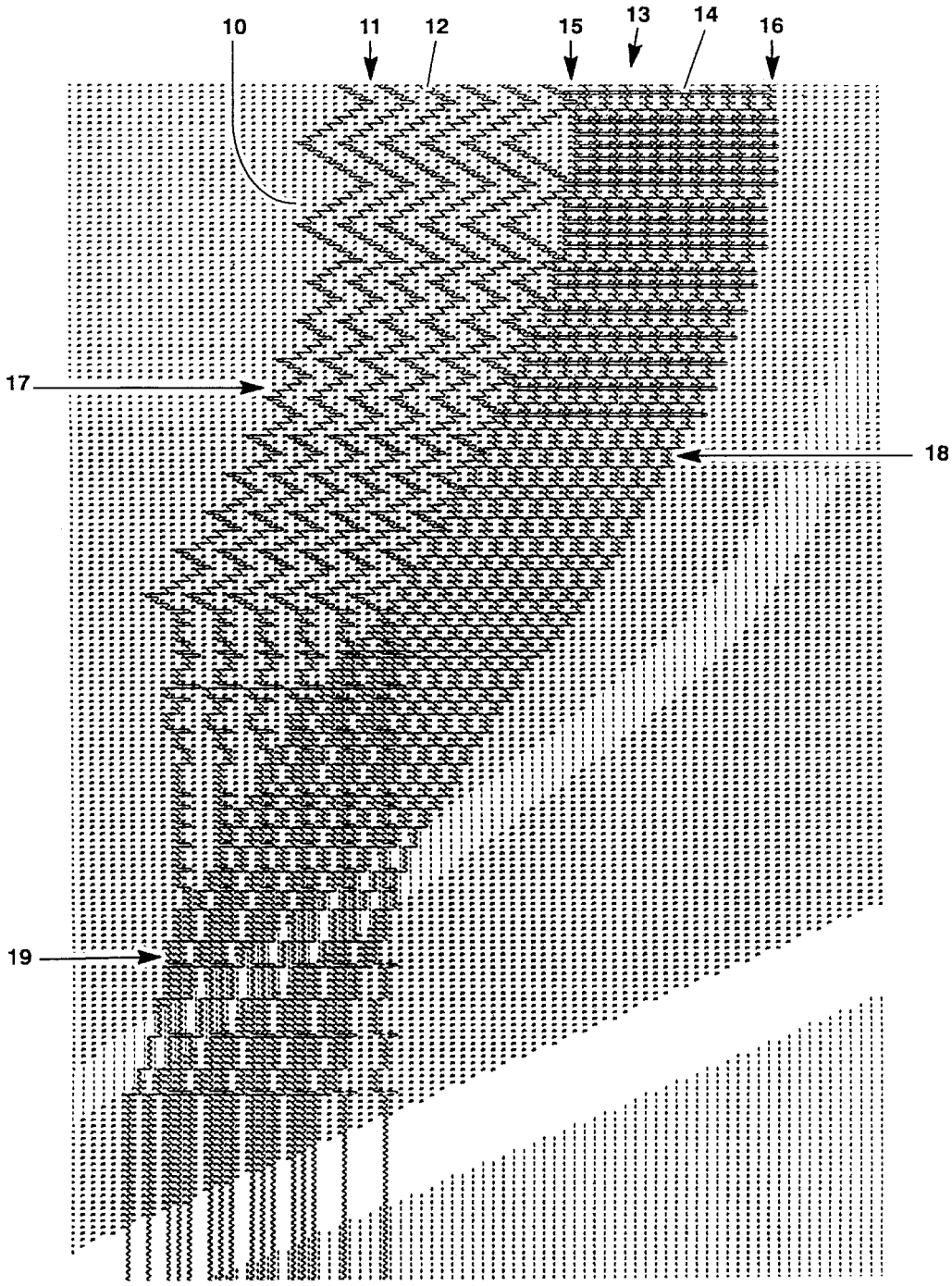
FIG. 2 is an enlargement of sector A as shown in FIG. 1.

With reference now to FIG. 2, there is provided an elastic function zone 10 within the pattern area 2 that is further explained hereinbelow. More particularly, a first group 11 of six elastic threads 12 is provided, with separation from each other, in a first controllable guide bar of the warp knitting machine (not shown). In addition, a second group 13 of ten elastic threads 14 is provided, corresponding to the machine gauge, to a second controllable guide bar of the warp knitting machine (not shown).

By corresponding control of the guide bars (not shown), each thread 12 of first group 11 follows a first contour 15 and each thread 14 of the second group 13 follows a second contour 16. The amplitude of the second contour 16 is greater than that of the first contour 15. In the foregoing arrangement, three areas of differential elastic returnability are created. The elastic returnability is the least in area 17 and is the greatest in area 19, wherein both thread groups 11 and 13 overlap. The elastic returnability of area 18 is intermediate that of areas 17 and 19, i.e., it is greater than the elastic returnability of area 17, but less that the elastic returnability of area 19.

After the completion a fabric structure of the foregoing type, the individual pattern areas 2 are separated from neighboring pattern areas (not specifically shown) and the fill areas 3 are removed, e.g., by cutting, loosening the separating threads, burning (laser technique) or any other mode known in the art. The front and rear portions of the resulting garment piece need only to be connected with side stitches to other garment pieces in order to create the final garment. As illustrated here, a ladies slip, during the knitting process has already been provided with an elastic function zone in the area of separation between the legs.

It is desirable that a portion of the elastic threads are woven in a manner wherein, within a given pattern of elastic threads, the pattern has a transverse shogging of at least twenty wales. It is particularly desirable to provide a transverse shogging of at least forty wales. Such large displacement paths allow for accommodating widely deviated contours.

It will be understood that the embodiments described herein are merely exemplary and that a person skilled in the art may make many variations and modifications without departing from the spirit and scope of the present invention. For instance, the fabric structure of the present invention may also include lace bands, plain lace, single or double bedded smooth or jacquard goods, or separately created fabrics. All such variations and modifications are intended to be included within the scope of the invention.

What is claimed is:

1. In a fabric structure for the formation of garment pieces, said fabric structure having a warp direction and a plurality of pattern areas corresponding to garment pieces and connected by filling areas, each of said pattern areas including at least two different patterns, the improvement comprising at least one elastic function zone formed by at least two thread groups each of said thread groups including a plurality of elastic threads that are sequentially woven, in the warp direction of said fabric structure, into successive pattern areas along a contour which deviates from a path parallel to the warp direction, each of said thread groups being woven into said fabric structure in a different manner, whereby said thread groups can be differentiated from one another.

2. Fabric structure in accordance with claim 1, wherein each of said at least two thread groups is woven along a different contour.

3. Fabric structure in accordance with claim 1, wherein each of said at least two thread groups is woven with a different density.

4. Fabric structure in accordance with claim 1, wherein each of said at least two thread groups is woven with a different tension.

5. Fabric structure in accordance with claim 1, wherein said at least two thread groups at least partially overlap each other.

6. Fabric structure in accordance with claim 2, wherein said plurality of elastic threads crosses said at least two different patterns in each of said plurality of pattern areas.

7. Fabric structure in accordance with claim 2, wherein some of said plurality of elastic threads are woven with a transverse shogging of at least twenty wales.

8. Fabric structure in accordance with claim 7, wherein said shogging includes at least forty wales.

9. A garment piece for the creation of a garment, comprising a pattern area having a warp direction and at least one elastic function zone formed by at least two thread groups, each of said thread groups including a plurality of elastic threads that are sequentially woven, in the warp direction, along a contour which deviates from a path parallel to the warp direction, each of said thread groups being woven in a different manner, whereby said thread groups can be differentiated from one another.

10. A garment, comprising at least one garment piece including a pattern area having a warp direction and at least one elastic function zone formed by at least two thread groups, each of said thread groups including a plurality of elastic threads that are sequentially woven, in the warp direction, along a contour which deviates from a path parallel to the warp direction, each of said thread groups being woven in a different manner, whereby said thread groups can be differentiated from one another.

* * * * *